US011335479B1

(12) United States Patent
Chen et al.

(10) Patent No.: US 11,335,479 B1
(45) Date of Patent: May 17, 2022

(54) COMPOSITE CIRCUIT PROTECTION DEVICE

(71) Applicant: Fuzetec Technology Co., Ltd., New Taipei (TW)

(72) Inventors: Jack Jih-Sang Chen, New Taipei (TW); Chang-Hung Jiang, New Taipei (TW)

(73) Assignee: Fuzetec Technology Co., Ltd., New Taipei (TW)

( * ) Notice: Subject to any disclaimer, the term of this patent is extended or adjusted under 35 U.S.C. 154(b) by 0 days.

(21) Appl. No.: 17/142,577

(22) Filed: Jan. 6, 2021

(51) Int. Cl.
*H01C 1/14* (2006.01)
*H01C 7/02* (2006.01)

(52) U.S. Cl.
CPC ..... *H01C 1/1406* (2013.01); *H01C 7/021* (2013.01); *H01C 7/028* (2013.01)

(58) Field of Classification Search
CPC ..... H01C 1/1406; H01C 7/021; H01C 7/028
See application file for complete search history.

(56) References Cited

U.S. PATENT DOCUMENTS 6,489,879 B1 * 12/2002 Singh ..... H01C 1/1406 337/167
9,443,825 B2 * 9/2016 Lien ..... H01L 25/0657
2006/0176675 A1 * 8/2006 Bourns ..... H01C 1/148 361/780
2006/0215342 A1 * 9/2006 Montoya ..... H01C 1/148 361/103
2012/0127619 A1 * 5/2012 Mikolajczak ..... H02H 3/023 361/79
2012/0170163 A1 * 7/2012 Mikolajczak ..... H01L 24/40 361/57
2012/0227229 A1 * 9/2012 Montoya ..... H01C 1/148 29/25.01
2016/0240510 A1 * 8/2016 Lien ..... H01L 25/0652

* cited by examiner

*Primary Examiner* — Kyung S Lee
(74) *Attorney, Agent, or Firm* — Christensen O'Connor Johnson Kindness PLLC

(57) ABSTRACT

A composite circuit protection device includes: a positive temperature coefficient (PTC) component which includes a positive temperature coefficient (PTC) layer that has two opposite surfaces, and first and second electrode layers that are respectively disposed on the two opposite surfaces of the PTC layer; a diode component that is connected to the second electrode layer of the PTC component; a first conductive lead that is bonded to the first electrode layer of the PTC component; and a second conductive lead that is bonded to the diode component. The PTC component has a rated voltage that ranges between 50% and 250% of a breakdown voltage of the diode component as determined at 1 mA.

19 Claims, 4 Drawing Sheets

COMPOSITE CIRCUIT PROTECTION DEVICE

FIELD

The disclosure relates to a composite circuit protection device, and more particularly to a composite circuit protection device having a positive temperature coefficient (PTC) component with a rated voltage that ranges between 50% and 250% of a breakdown voltage of a diode component as determined at 1 mA.

BACKGROUND

U.S. Pat. No. 8,508,328 B1 discloses an insertable polymer positive temperature coefficient (PPTC) over-current protection device that includes first and second electrodes 30, an encapsulant, conductive lead pins 50, 60 bonded to the first and second electrodes 30, respectively, and a PTC polymer matrix 20 laminated between the first and second electrodes 30 (see FIG. 1). The PTC polymer matrix 20 may be formed with a hole 40 that has an effective volume to accommodate thermal expansion of the PTC polymer matrix 20 at increased temperature.

Electrical properties (e.g., operating current and high-voltage surge endurability) are important factors which affect the occurrence of power surge in the PPTC over-current protection device. When the operating current of the PPTC over-current protection device is increased by increasing the thickness or the area of the PTC polymer matrix 20, the PPTC over-current protection device might become more vulnerable to power surge. On the other hand, when the high-voltage endurability of the PPTC over-current protection device is increased by decreasing the thickness or the area of the PTC polymer matrix 20, the PPTC over-current protection device is not necessarily less vulnerable to power surge.

Although a diode could be combined with the PTC component to impart over-current and over-voltage protection to the resultant composite circuit protection device, the diode might only withstand power surge for a short time period (such as 0.001 seconds). That is, if a time period of the power surge exceeds a cut-off time period, the diode might be burned out or damaged due to over-current and over-voltage, causing permanent loss of function of the composite circuit protection device.

SUMMARY

Therefore, an object of the disclosure is to provide a composite circuit protection device that can alleviate at least one of the drawbacks of the prior art.

According to this disclosure, a composite circuit protection device includes a positive temperature coefficient (PTC) component, a diode component, a first conductive lead, and a second conductive lead. The PTC component includes a PTC layer that has two opposite surfaces, and first and second electrode layers that are respectively disposed on the two opposite surfaces of the PTC layer. The diode component is connected to the second electrode layer of the PTC component. The first conductive lead is bonded to the first electrode layer of the PTC component, and the second conductive lead is bonded to the diode component. The PTC component has a rated voltage that ranges between 50% and 250% of a breakdown voltage of the diode component as determined at 1 mA.

BRIEF DESCRIPTION OF THE DRAWINGS

Other features and advantages of the present disclosure will become apparent in the following detailed description of the embodiment with reference to the accompanying drawing, of which.

DETAILED DESCRIPTION

Figure 1:
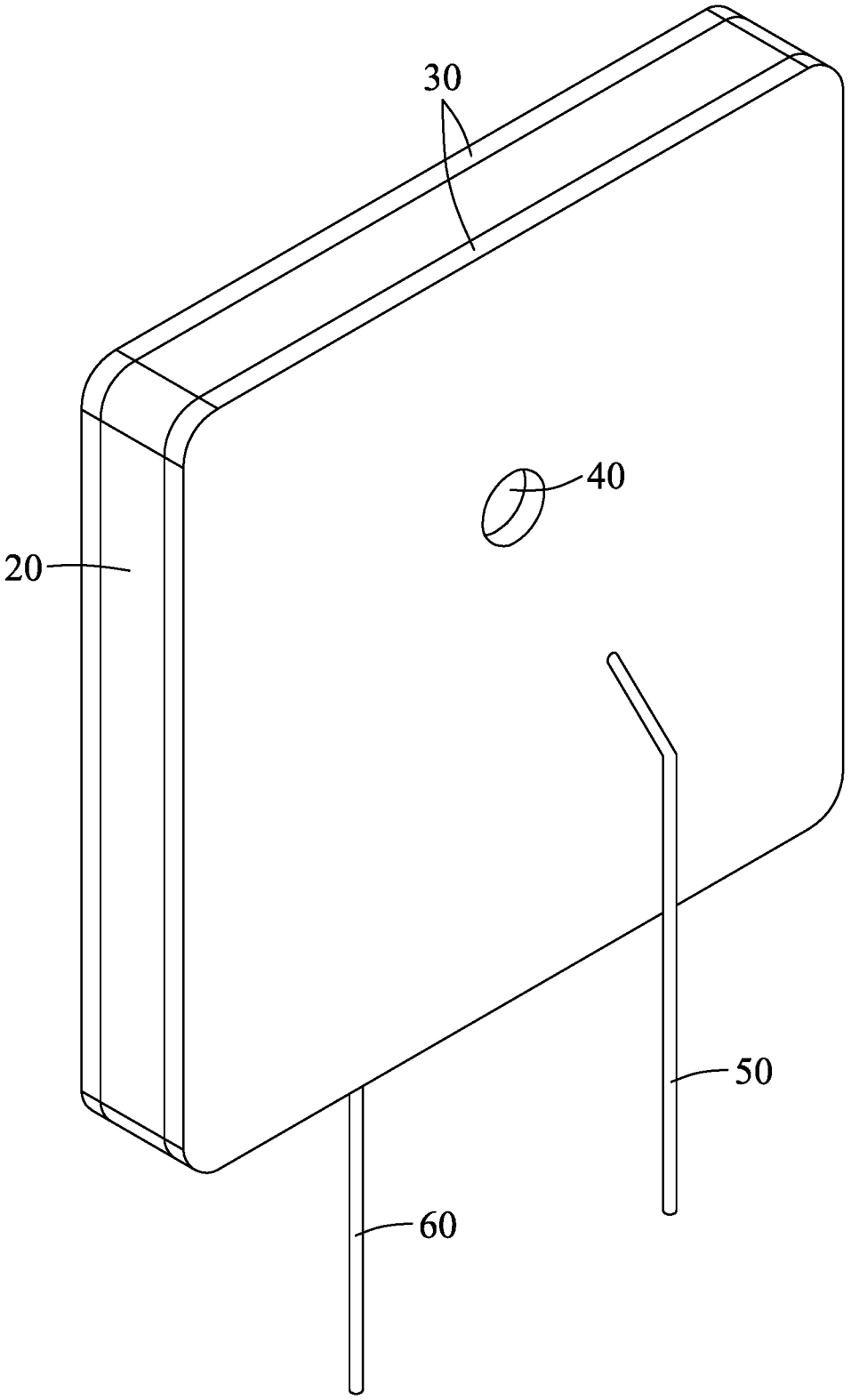
FIG.1 PRIOR ART
FIG. 1 is a perspective view of a conventional insertable PTC over-current protection device.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
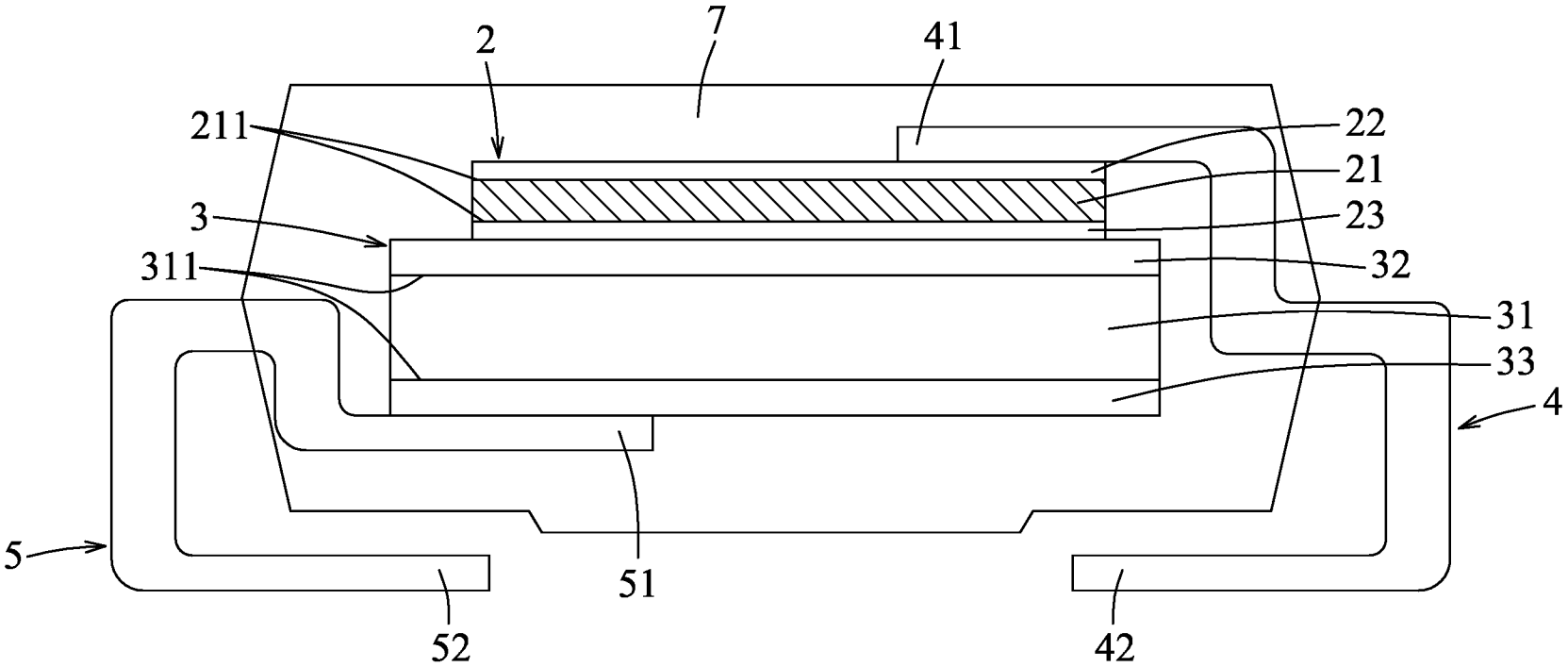
FIG. 2 is a schematic sectional view of a first embodiment of a composite circuit protection device according to the present disclosure.

Referring to FIG. 2, a first embodiment of a composite circuit protection device according to the present disclosure includes a positive temperature coefficient (PTC) component 2, a diode component 3, a first conductive lead 4, and a second conductive lead 5.

Specifically, the PTC component 2 includes a PTC layer 21 having two opposite surfaces 211, and first and second electrode layers 22, 23 respectively disposed on the two opposite surfaces 211 of the PTC layer 21. In certain embodiments, the first and second electrode layers 22, 23 are connected to the PTC layer 21 through a solder material. The diode component 3 is connected to the second electrode layer 23 of the PTC component 2. The first conductive lead 4 is bonded to the first electrode layer 22 of the PTC component 2, and the second conductive lead 5 is bonded to the diode component 3.

According to this disclosure, the PTC component 2 has a rated voltage that ranges between 50% and 250% of a breakdown voltage of the diode component 3 as determined at 1 mA. In certain embodiments, the rated voltage of the PTC component 2 ranges between 70% and 230% of the breakdown voltage of the diode component 3 as determined at 1 mA.

The PTC component 2 trips before the diode component 3 burns out in the presence of an over-current and an over-voltage that is greater than a breakdown voltage of the diode component 3. In other words, when the over-voltage present is greater than the rated voltage of the PTC component 2, the PTC component 2 quickly trips to a high resistance state, such that the over-current is restricted from flowing through the diode component 3, thereby protecting the diode component 3 from burning out. The composite circuit protection device can therefore be repeatedly used.

In this disclosure, the over-voltage is lower than a total of the rated voltage of the PTC component 2 and the breakdown voltage of the diode component 3.

As used herein, the term "burn out" refers to the diode component 3 being out of function, which typically occurs at a temperature of 180° C. or higher.

According to this disclosure, the PTC component 2 may be a polymer positive temperature coefficient (PPTC) component, and the PTC layer 21 may be a PTC polymeric layer that includes a polymer matrix and a conductive filler dispersed in the polymer matrix. The polymer matrix may be made from a polymer composition that contains a non-grafted olefin-based polymer. In certain embodiments, the non-grafted polyolefin is high density polyethylene (HDPE). In certain embodiments, the polymer composition of the polymer matrix further includes a grafted olefin-based polymer.

In certain embodiments, the grafted olefin-based polymer includes a carboxylic acid anhydride-grafted olefin-based polymer. Examples of the conductive filler suitable for use in this disclosure include, but are not limited to, carbon black powder, metal powder, electrically conductive ceramic powder, and combinations thereof. Specifically, the diode component 3 includes a diode structure 31 having two opposite surfaces 311, a third electrode layer 32 disposed on one of the two opposite surfaces 311 of the diode structure 31, and a fourth electrode layer 33 disposed on the other one of the two opposite surfaces 311 of the diode structure 31. The third electrode layer 32 is connected to the second electrode layer 23 of the PTC component 2 through, e.g., a solder material. The second conductive lead 5 is bonded to one of the third and fourth electrode layers 32, 33 of the diode component 3.

The PTC component 2 and the diode component 3 may be connected in series or in parallel. The diode component 3 may be a transient-voltage-suppression (TVS) diode, which includes a silicon wafer having a PN junction.

In this embodiment, the first conductive lead 4 has a connecting portion 41 and a free portion 42, while the second conductive lead 5 has a connecting portion 51 and a free portion 52. The connecting portion 41 of the first conductive lead 4 is bonded to an outer surface of the first electrode layer 22 of the PTC component 2 through a solder material, and the free portion 42 extends outwardly from the connecting portion 41 beyond the first electrode layer 22 for insertion into a pin hole in a circuit board or a circuit device (not shown in the figures).

In this embodiment, the connecting portion 51 of the second conductive lead 5 is bonded to an outer surface of the fourth electrode layer 33 of the diode component 3 through a solder material, and the free portion 52 extends outwardly from the connecting portion 51 beyond the fourth electrode layer 33 for insertion into a pin hole in a circuit board or a circuit device (not shown in the figures).

According to this disclosure, the composite circuit protection device may further include an encapsulant 7 enclosing the PTC component 2, the diode component 3, a part of the first conductive lead 4 and a part of the second conductive lead 5.

The free portions 42, 52 of the first and second conductive leads 4, 5 are exposed from the encapsulant 7. In certain embodiments, the encapsulant 7 is made from epoxy resin.

Figure 3:
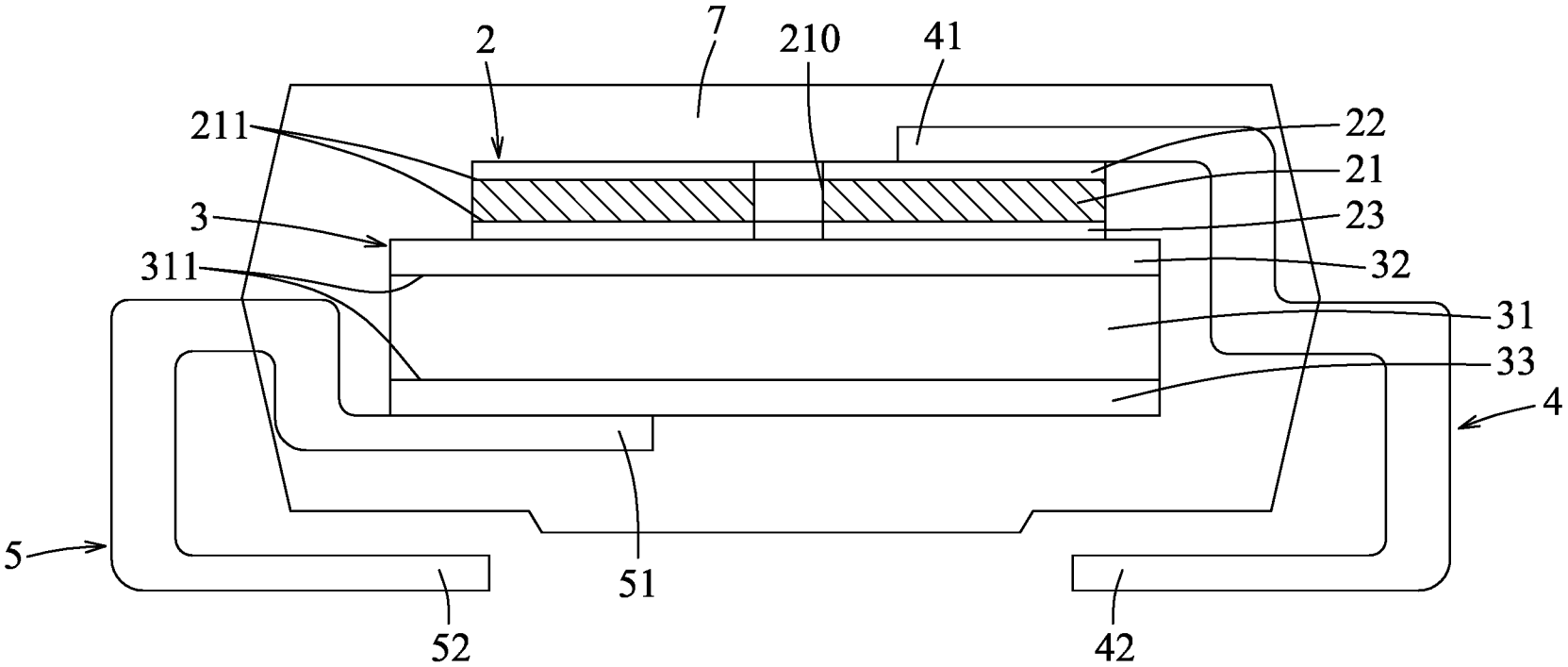
FIG. 3 is a schematic sectional view of a variation of the first embodiment of the composite circuit protection device according to the present disclosure.

Referring to FIG. 3, a variation of the first embodiment of a composite circuit protection device according to the present disclosure is similar to the first embodiment. The difference resides in that, the PTC component 2 is formed with a hole 210. In this embodiment, the hole 210 is formed in the PTC layer 21. The PTC layer 21 of the PTC component 2 has a peripheral edge that defines a boundary of the PTC layer 21 and that interconnects the two opposite surfaces 211 of the PTC layer 21. The hole 210 is spaced apart from the peripheral edge of the PTC layer 21, and has an effective volume to accommodate thermal expansion of the PTC layer 21 at increased temperature, so as to avoid undesired structural deformation of the PTC layer 21.

In certain embodiments, the hole 210 extends through at least one of the two opposite surfaces 211 of the PTC layer 21. In certain embodiments, the hole 210 further extends through at least one of the first and second electrode layers 22, 23. In this embodiment, the hole 210 extends through the first and second electrode layers 22, 23. In certain embodiments, the hole 210 extends along a line passing through a geometrical center of the PTC layer 21 and is transverse to the opposite surfaces 211 of the PTC layer 21. The hole 210 is defined by a hole-defining wall having a cross section that may be parallel to the surface 211 of the PTC layer 21. The cross section of the hole-defining wall may be in a shape of circle, square, oval, triangle, crisscross, or etc.

Figure 4:
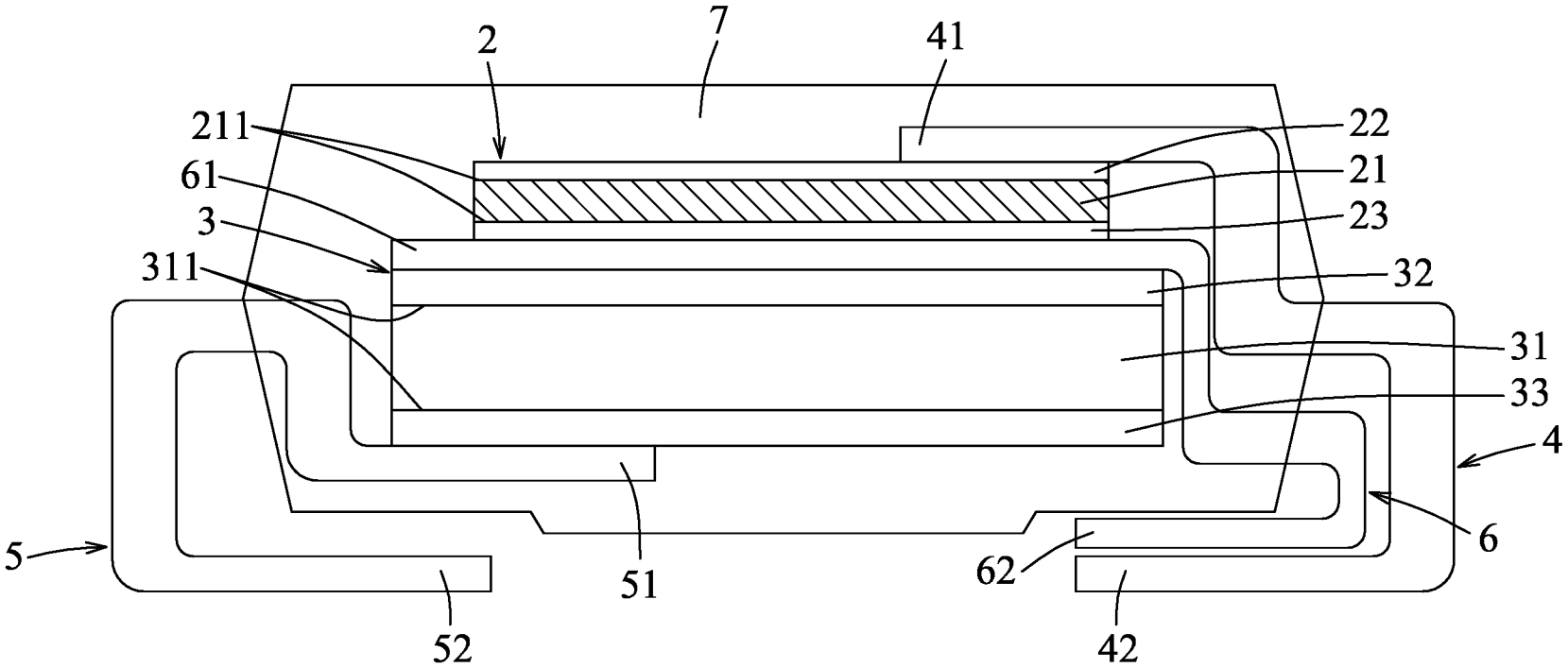
FIG. 4 is a schematic sectional view of a second embodiment of the composite circuit protection device according to the present disclosure.

Referring to FIG. 4, a second embodiment of a composite circuit protection device according to the present disclosure is similar to the first embodiment. The difference resides in that, the composite circuit protection device of the second embodiment further includes a third conductive lead 6. In this embodiment, the second conductive lead 5 is bonded to the fourth electrode layer 33 through, e.g., a solder material, and the third conductive lead 6 is bonded to and disposed between the second and third electrode layers 23, 32 through, e.g., a solder material.

The third conductive lead 6 has a connecting portion 61 that is connected to the second and third electrode layers 23, 32, and a free portion 62 that extends outwardly from the connecting portion 61 beyond the second and third electrode layers 23, 32 for insertion into a pin hole in a circuit board or a circuit device (not shown in the figures).

In this embodiment, the encapsulant 7 encloses the PTC component 2, the diode component 3, a part of the first conductive lead 4, a part of the second conductive lead 5, and a part of the third conductive lead 6. The free portions 42, 52, 62 of the first, second and third conductive leads 4, 5, 6 are exposed from the encapsulant 7.

The disclosure will be further described by way of the following examples and comparative examples. However, it should be understood that the following examples are solely intended for the purpose of illustration and should not be construed as limiting the disclosure in practice.

EXAMPLES

Example 1 (E1)

12.5 grams of HDPE (purchased from *Formosa* Plastics Corp., catalog no.: HDPE9002) serving as the non-grafted olefin-based polymer, 12.5 grams of carboxylic acid anhydrides grafted HDPE (purchased from Dupont, catalog no.: MB100D) serving as the carboxylic acid anhydride-grafted olefin-based polymer, and 25 grams of carbon black powder (purchased from Columbian Chemicals Co., catalog no.: Raven 430UB) serving as the conductive filler were compounded in a Brabender mixer. The compounding procedure was carried out at 200° C. for 10 minutes with a stirring rate of 30 rpm.

The resultant compounded mixture was hot-pressed in a mold under 200° C. and 80 kg/cm$^2$ for 4 minutes so as to form a PTC polymeric layer with a thickness of 0.6 mm. Two copper foil sheets (serving as the first electrode layer and the second electrode layer, respectively) were respectively attached to the two opposite surfaces of the PTC polymeric layer and were hot pressed under 200° C. and 80 kg/cm$^2$ for 4 minutes, so as to form polymer positive temperature coefficient (PPTC) structure. The PPTC structure was cut into a plurality of PPTC chips, each of which has a size of 1.0 mm×1.0 mm. Each PPTC chip was irradiated with a Cobalt-60 gamma ray for a total irradiation dose of 150 kGy, and welded with a diode component (a TVS diode, purchased from Lucky Forests Corporation, Catalogue no: SMAJ24A). In this example, the PPTC chip and the diode component were connected in series. Then, first and second conductive leads were respectively welded to one of the copper foils sheets of the PPTC chip and the diode component, so as to form a composite circuit protection device as shown in FIG. 2.

The PPTC chip was subjected to determination of a hold current (i.e., a maximum current value which can be applied in normal operation), a trip current (i.e., a minimum current value which is necessary for the PPTC component to achieve a high-resistance state), a rated voltage (i.e., a voltage at which the PPTC chip is designed to work with) and a withstand voltage (i.e., a maximum voltage limit which will not cause the PPTC chip to be malfunctioned or damaged) according to the Underwriter Laboratories UL 1434 Standard for Safety for Thermistor-Type Devices. The characteristic results of the PPTC chip are provided in Table 1.

In addition, the TVS diode was subjected to determination of a breakdown voltage (i.e., the voltage where the diode component begins to conduct current) and a clamping voltage (i.e., the voltage developed across the diode component under maximum transient current condition) according to the Underwriter Laboratories UL 497B Standard for Safety for Transient Voltage Surge Suppressors. The characteristic results of the diode component are provided in Table 2.

TABLE 1

| | Hold current | Trip current | Rated voltage | Withstand voltage |
|---|---|---|---|---|
| PPTC | 0.01 A | 0.03 A | 60 V | 60 V |

TABLE 2

| | $V_{BR}$ at 1 mA | Clamping Voltage (10/1000 μs, $I_p$ = 10.3 A) |
|---|---|---|
| TVS SMAJ24A | 27 | 38.9 |
| TVS SMAJ75A | 83.3 | 121 |

$I_p$: test pulse current
$V_{BR}$: breakdown voltage

Examples 2 (E2)

The procedures and conditions for preparing the composite circuit protection devices of E2 were similar to those of E1, except that after Co-60 gamma ray irradation, a central portion of each PPTC chip was punched to form a through-hole which was defined by a hole-defining wall with a circular cross section that has a diameter (d) of 0.15 mm and an area ($\pi d^2/4$) of 0.0177 $mm^2$.

Examples 3 to 4 (E3 to E4)

The procedures and conditions for preparing the composite circuit protection devices of E3 and E4 were respectively similar to those of E1 and E2, except that the PPTC chip and the TVS diode in each of the E3 and E4 were connected in parallel.

Examples 5 to 8 (E5 to E8)

The procedures and conditions in preparing the composite circuit protection devices of E5 to E8 were similar to those of E1 to E4, respectively, except that the TVS diode used in each of E5 to E8 was the one with Catalogue no. of SMAJ75A (purchased from Lucky Forests Corporation).

Comparative Examples 1 to 2 (CE1 to CE2)

The circuit protection device of CE1 only included the PPTC chip used in E1. In other words, the circuit protection device of CE1 did not include the TVS diode. Similarly, the circuit protection device of CE2 only included the PPTC chip used in E2, and did not include the TVS diode.

Comparative Examples 3 to 4 (CE3 to CE4)

The device of CE3 only included the TVS diode used in E1. In other words, the circuit protection device of CE3 did not include the PPTC chip. Similarly, the circuit protection device of CE4 only included the TVS diode used in E5, and did not include the PPTC chip. For simplicity, the structure of the composite circuit protection devices of E1 to E8 and CE1 to CE4 are summarized in Table 3, where V is an indicator for existence.

TABLE 3

| | PPTC | Hole | TVS element | Electrical connection between PPTC chip and TVS diode |
|---|---|---|---|---|
| E1 | V | | SMAJ24A | In series |
| E2 | V | V | SMAJ24A | In series |
| E3 | V | | SMAJ24A | In parallel |
| E4 | V | V | SMAJ24A | In parallel |
| E5 | V | | SMAJ75A | In series |
| E6 | V | V | SMAJ75A | In series |
| E7 | V | | SMAJ75A | In parallel |
| E8 | V | V | SMAJ75A | In parallel |
| CE1 | V | | | |
| CE2 | V | V | | |
| CE3 | | | SMAJ24A | |
| CE4 | | | SMAJ75A | |

Performance Test

Surge Immunity Test

Ten of the composite circuit protection devices of each of E1 to E4 and CE1 to CE3, each serving as a test device, were subjected to a surge immunity test.

The surge immunity test for each of the test devices of E1 to E4 and CE1 to CE3 was conducted in the presence of a voltage (including 30 Vdc and 40 Vdc) that is greater than the breakdown voltage of the TVS diode and a current of 0.1 A or an over-current for the PPTC chip (i.e., 10 A), by switching on for 60 seconds and then off. If both of the PPTC chip and the TVS diode were not burned out and damaged, the test device was determined to pass the surge immunity test, and the average of the time period at which the PPTC chip of the test device tripped (i.e., trip time), if any, was recorded. If one of the PPTC chip and the TVS diode was burned out, the test device was determined as burned out, and the average of the time period at which the PPTC chip or the TVS diode was burned out (i.e., burned-out time) was recorded. The results are shown in Table 4.

TABLE 4

| | 30 V/0.1 A | | 30 V/10 A | | 40 V/0.1 A | | 40 V/10 A | |
|---|---|---|---|---|---|---|---|---|
| | Trip time(s) | Result | Trip time(s) | Result | Trip time(s) | Result | Trip time(s) | Result |
| E1 | 0.110 | Passed | 0.045 | Passed | 0.095 | Passed | 0.035 | Passed |
| E2 | 0.105 | Passed | 0.040 | Passed | 0.090 | Passed | 0.030 | Passed |
| E3 | 0.105 | Passed | 0.045 | Passed | 0.095 | Passed | 0.035 | Passed |
| E4 | 0.100 | Passed | 0.040 | Passed | 0.090 | Passed | 0.030 | Passed |
| CE1 | 0.145 | Passed | 0.055 | Passed | 0.130 | Passed | 0.040 | Passed |
| CE2 | 0.140 | Passed | 0.050 | Passed | 0.125 | Passed | 0.040 | Passed |
| CE3 | 0.160 | TVS diode burned | 0.085 | TVS diode burned | 0.135 | TVS diode burned | 0.045 | TVS diode burned |

Note:
For test device with result that is shown as passed, the time recorded refers to the time period for the PPTC chip to be tripped.
For test device with result that is shown as TVS diode burned, the time recorded refers to the time period for the TVS diode to be burned out.
For test device with result that is shown as PPTC chip burned, the time recorded refers to the time period for the PPTC chip to be burned out.

As shown in Table 4, the test device of CE3 including only the TVS diode was burned out within 0.2 seconds under the current of 0.1 A and the over-voltage of 30 V that is greater than the $V_{BR}$ of the TVS diode, or burned out within 0.1 seconds under the over-current of 10 A and the over-voltage of 30 V, and such damage cannot be repaired. In contrast, all of the test devices of E1 to E4 including the combination of the PPTC chip and the TVS diode passed the surge immunity test without being burned out. Besides, formation of the through-hole in the PPTC chip improves the heat transfer of each of the test devices of E2 and E4, which may further shorten the time period for the PPTC chip to be tripped, and thus prevents the over-current from flowing through the TVS diode, thereby protecting the TVS diode of the test devices from being burned out. In other words, the TVS diodes in the test devices of E1 to E4 were not damaged, as the PPTC components trip before the TVS diodes burn out. Moreover, for each of the test devices of E3 and E4, in which the PPTC chip and the TVS diode were connected in parallel, the PPTC component still trips before the TVS diode burns out, thereby protecting the TVS diode of the test device from being burned out.

Moreover, each of the test devices of E5 to E8 and CE1, CE2 and CE4 was subjected to the surge immunity test in the presence of a voltage (including 90 Vdc and 120 Vdc) that is greater than the breakdown voltage of the TVS diode (Catalogue no.: SMAJ75A) and a current of 0.1 A or an over-current for the PPTC chip (i.e., 5 A), by switching on for 60 seconds and then off. The results and time period at which the test devices tripped are shown in Table 5.

TABLE 5

| | 90 V/0.1 A | | 90 V/5 A | | 120 V/0.1 A | | 120 V/5 A | |
|---|---|---|---|---|---|---|---|---|
| | Trip time(s) | Result | Trip time(s) | Result | Trip time(s) | Result | Trip time(s) | Result |
| E5 | 0.105 | Passed | 0.040 | Passed | 0.090 | Passed | 0.030 | Passed |
| E6 | 0.110 | Passed | 0.035 | Passed | 0.085 | Passed | 0.025 | Passed |
| E7 | 0.105 | Passed | 0.040 | Passed | 0.090 | Passed | 0.030 | Passed |
| E8 | 0.095 | Passed | 0.035 | Passed | 0.085 | Passed | 0.025 | Passed |
| CE1 | 0.120 | PPTC burned | 0.040 | PPTC burned | 0.115 | PPTC burned | 0.035 | PPTC burned |
| CE2 | 0.115 | PPTC burned | 0.035 | PPTC burned | 0.115 | PPTC burned | 0.035 | PPTC burned |
| CE4 | 0.255 | TVS diode burned | 0.135 | TVS diode burned | 0.165 | TVS diode burned | 0.055 | TVS diode burned |

Note:
For test device with result that is shown as passed, the time recorded refers to the time period for the PPTC chip to be tripped.
For test device with result that is shown as TVS diode burned, the time recorded refers to the time period for the TVS diode to be burned out.
For test device with result that is shown as PPTC chip burned, the time recorded refers to the time period for the PPTC chip to be burned out.

As shown in Table 5, each of the test devices of CE1, CE2 and CE4 including only the PPTC chip or only the TVS diode was burned out under a current of 0.1 A or 5 A, as the testing voltage is higher than the rated voltage of the PPTC chip. For the test device of CE4, in which the voltage is greater than the breakdown voltage of the TVS diode, the TVS diode was burned out within 0.26 and 0.14 seconds under a current of 0.1 A or 5 A, and such damage cannot be repaired.

In contrast, all of the test devices of E5 to E8, each of which includes the combination of the PPTC chip and the TVS diode, passed the surge immunity test without being burned out. Moreover, formation of the through-hole in the PPTC chip improves the heat transfer, which further shortens the time period for the PPTC chip to be tripped, and thus prevents the over-current from flowing through the TVS diode, thereby protecting the TVS diode of each of the test devices from being burned out. For each of the test devices of E7 and E8, in which the PPTC chip and the TVS diode were connected in parallel, the PPTC chip trips before the TVS diode burns out in the presence of a voltage that is greater than the breakdown voltage of the TVS diode. For each of the test devices of E5 to E8, the test voltage is higher than the rated voltage of the PPTC chip. However, by setting the total of the rated voltage of the PPTC chip and the breakdown voltage of the TVS diode to be higher than the test voltage, the test devices still pass the surge immunity test due to the voltage division effect between the PPTC chip and the TVS diode.

In conclusion, with the inclusion of the PTC component 2 having the desired rated voltage (such as 50% to 250% of the breakdown voltage of the diode component as determined at 1 mA), the PTC component 2 that could quickly trip to a high-resistance state in the presence of an over-current and an over-voltage, is capable of protecting the diode component 3 from being burned out by the over-current, and thus the composite circuit protection device of this disclosure can be repeatedly used without being damaged, which demonstrates its excellent endurability and reliability.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A composite circuit protection device, comprising:

a positive temperature coefficient (PTC) component that includes a positive temperature coefficient (PTC) layer having two opposite surfaces, and first and second electrode layers respectively disposed on said two opposite surfaces of said PTC layer;

a diode component that is connected to said second electrode layer of said PTC component;

a first conductive lead that is bonded to said first electrode layer of said PTC component; and a second conductive lead that is bonded to said diode component, wherein said PTC component has a rated voltage that ranges between 50% and 250% of a breakdown voltage of said diode component as determined at 1 mA.

2. The composite circuit protection device of claim 1, wherein the rated voltage of said PTC component ranges between 70% and 230% of the breakdown voltage of said diode component as determined at 1 mA.

3. The composite circuit protection device of claim 1, wherein said PTC component is formed with a hole.

4. The composite circuit protection device of claim 3, wherein said hole extends through at least one of said two opposite surfaces of said PTC layer.

5. The composite circuit protection device of claim 3, wherein said PTC layer of said PTC component has a peripheral edge defining a boundary of said PTC layer and interconnecting said two opposite surfaces of said PTC layer, said hole being spaced apart from said peripheral edge of said PTC layer.

6. The composite circuit protection device of claim 4, wherein said hole further extends through at least one of said first and second electrode layers.

7. The composite circuit protection device of claim 1, wherein said diode component includes a diode structure having two opposite surfaces, a third electrode layer disposed on one of said two opposite surfaces of said diode structure and connected to said second electrode layer of said PTC component, and a fourth electrode layer disposed on the other one of said two opposite surfaces of said diode structure, wherein said second conductive lead is bonded to one of said third and fourth electrode layers of said diode component.

8. The composite circuit protection device of claim 7, further comprising a third conductive lead, said second conductive lead being bonded to said fourth electrode layer, said third conductive lead being bonded to and disposed between said second and third electrode layers.

9. The composite circuit protection device of claim 1, wherein said PTC component and said diode component are connected in series.

10. The composite circuit protection device of claim 1, wherein said PTC component and said diode component are connected in parallel.

11. The composite circuit protection device of claim 1, wherein said diode component is a transient-voltage-suppression (TVS) diode.

12. The composite circuit protection device of claim 11, wherein said transient-voltage-suppression (TVS) diode includes a silicon wafer having a PN junction.

13. The composite circuit protection device of claim 1, wherein said PTC component is a polymer positive temperature coefficient (PPTC) component, and said PTC layer is a PTC polymeric layer.

14. The composite circuit protection device of claim 13, wherein said PTC polymeric layer of said PPTC component includes a polymer matrix and a conductive filler dispersed in said polymer matrix.

15. The composite circuit protection device of claim 14, wherein said polymer matrix is made from a polymer composition containing a non-grafted olefin-based polymer.

16. The composite circuit protection device of claim 15, wherein said polymer composition further includes a carboxylic acid anhydride-grafted olefin-based polymer.

17. The composite circuit protection device of claim 14, wherein said conductive filler is selected from the group consisting of carbon black powder, metal powder, electrically conductive ceramic powder, and combinations thereof.

18. The composite circuit protection device of claim 1, further comprising an encapsulant enclosing said PTC component, said diode component, a part of said first conductive lead and a part of said second conductive lead.

19. The composite circuit protection device of claim 18, wherein said encapsulant is made from epoxy resin.

* * * * *